US008007259B2

(12) United States Patent
Kreidl et al.

(10) Patent No.: US 8,007,259 B2
(45) Date of Patent: Aug. 30, 2011

(54) STATOR SYSTEM

(75) Inventors: Johann Kreidl, Waldkraiburg (DE); Hisham Kamal, Waldkraiburg (DE); Mikael Tekneyan, Waldkraiburg (DE); Michael Robby, Muehldorf (DE); Helmuth Weber, Simach a.Inn (DE)

(73) Assignee: NETZSCH-Mohnopumpen GmbH (DE)

( * ) Notice: Subject to any disclaimer, the term of this patent is extended or adjusted under 35 U.S.C. 154(b) by 652 days.

(21) Appl. No.: 11/517,785

(22) Filed: Sep. 8, 2006

(65) Prior Publication Data

US 2007/0059191 A1 Mar. 15, 2007

(30) Foreign Application Priority Data

Sep. 8, 2005 (DE) ..... 10 2005 042 559

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 18/00*** | (2006.01) |

(52) U.S. Cl. ..... 418/48; 418/153

(58) Field of Classification Search ..... 418/48, 418/152, 153

See application file for complete search history.

(56) References Cited

U.S. PATENT DOCUMENTS

| | | | | |
|---|---|---|---|---|
| 3,104,615 | A * | 9/1963 | Szegvari | 418/48 |
| 3,499,389 | A * | 3/1970 | Seeberger et al. | 418/48 |

FOREIGN PATENT DOCUMENTS

| | | | |
|---|---|---|---|
| DE | 1 204 072 | | 10/1965 |
| DE | 1 553 126 | | 3/1971 |
| DE | 1303705 | | 8/1972 |
| DE | 279 043 | | 5/1990 |
| DE | 4111166 | A * | 10/1992 |
| DE | 4403598 | A1 * | 8/1995 |
| DE | 19811889 | A1 * | 9/1999 |
| DE | 198 21 065 | | 11/1999 |
| DE | 19950257 | A1 * | 4/2001 |
| DE | 100 42 335 | | 3/2002 |

* cited by examiner

*Primary Examiner* — Theresa Trieu

(74) *Attorney, Agent, or Firm* — St. Onge Steward Johnston & Reens LLC

(57) ABSTRACT

The invention relates to an eccentric screw pump and a method for its operation. Unlike the previously known prior art, where changes to the internal geometry of the pump stator caused by wear were always remedied with radially acting clamping measures, the invention is based on bringing this about by a change in the length of the lining.

6 Claims, 3 Drawing Sheets

Fig. 5
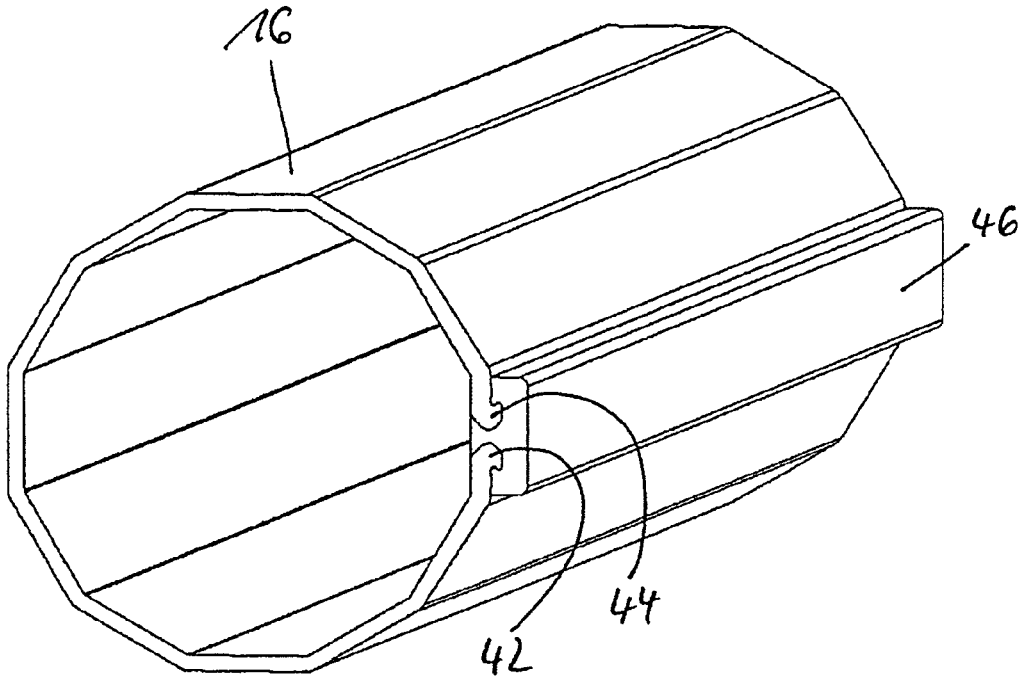
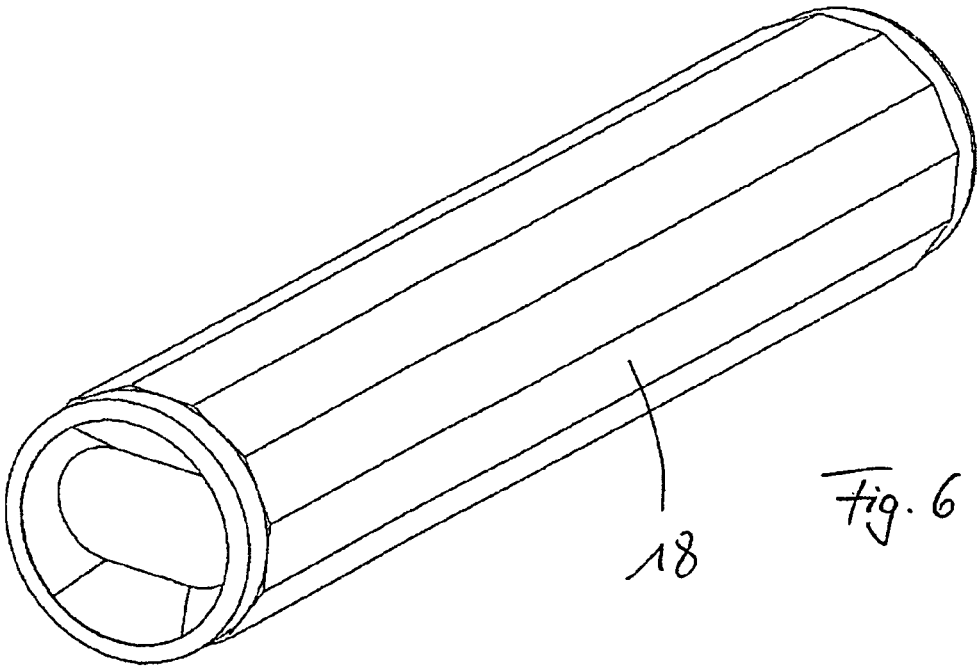
Fig. 6

STATOR SYSTEM

CROSS-REFERENCE TO RELATED APPLICATIONS

The present application claims priority of German patent application No. 10 2005 042 559.3 filed on Sep. 8, 2005, the content of which is incorporated herein by reference.

FIELD OF THE INVENTION

The invention relates to a method and a device for the operation of an eccentric screw pump wherein the internal dimensions of the stator are adapted to the circumstances arising during the operation.

BACKGROUND OF THE INVENTION

There emerges from DE 1303705 an eccentric screw pump whose useful life is to be extended. For this purpose, a pump design is provided which comprises a stator housing conical on the inside and a lining conical on the outside. If wear occurs on the lining that leads to an enlargement of the internal cross-section of the lining, the two conical parts, the stator housing and the lining, are shifted towards one another in the longitudinal direction. The lining is placed radially under pressure as a result of this relative movement, no change in the length of the lining of the stator taking place. The position of the lining is brought about by the transfer of compensating discs from the position in front of a flange into a position behind the flange.

DD 279043 A1 shows a stator structure of an eccentric screw pump which, as in DE 1303705, also comprises conically shaped parts, referred to here as sleeve and stator. The reduction in the internal diameter of the stator takes place by the shifting of the parts towards one another. This shifting process is initiated by a tensioning nut, with which a thrust piece shifts the stator into a sleeve.

DE 1553126 discloses in FIG. 4 the design of a rotor, which is made up of an internal and external polygonal sleeve and a polygonal lining.

A rotor designed screw-shaped on the outside can be found in DE 19821065. The stator sleeve and the lining are joined binder-free.

A longitudinally split stator sleeve is shown in FIG. 4 of DE 10042335. Two levers are shown as a closure, said levers entering with the second half of the sleeve element into a keyed connection.

In several examples of embodiment, DE 1 204 072 A1 shows the stator of an eccentric screw pump with the adjacent device parts of a storage container and an outlet pipe. The multi-part cylindrical stator housing is connected via screw connections to this storage container and to the outlet pipe. The distance between the storage container and also between the outlet pipe can be changed by various measures. This distance is changed either directly in the region of the storage container and the outlet pipe or in the central region between the two stator sleeve parts. As a result of the axial change in the distance between the storage container and the outlet pipe, an annular cap reduces the axial length of the stator lining from one or from both sides of the stator. Since, in all the examples of embodiment, the stator lining is clamped in the middle of its longitudinal extension between individual stator parts, a uniform distribution of the material of the stator lining does not take place in the region of the internal cross-section. Moreover, it emerges from all the examples of embodiment that each change in the length of the stator lining is accompanied by a change in the overall length of the pump.

The problem according to the invention consists in making it possible to adapt the pump to the most varied operating conditions without changing the pump length and only with a small assembly outlay.

SUMMARY OF THE INVENTION

The problem according to the invention is solved with the features stated here and below.

During the operation of an eccentric screw pump, account must be taken of the most varied phases which influence the mode of operation or the design of the pump parts actively involved in the delivery. By way of example, it can be stated that the pump naturally gives rise to different pump reactions when conveying slightly viscous to highly viscous products with or without abrasive particles, this becoming apparent during the start-up phase and in the normal pump operation.

In order to be able to respond to reactions of the pump, such as a drop in the delivery pressure, dry running, temperature increase or blockage, provision is made according to the invention to change the internal cross-section of the stator by shortening or lengthening the stator lining. For this purpose, the elastomer stator lining is subjected to an axial tensile or compressive action.

Abnormalities are most frequently detected due to the drop in the delivery pressure or the increase in the power consumption of the drive motor. Depending on how fast a reaction must take place, the adaptation of the internal dimensions of the stator lining can take place mechanically or electrically/electronically. It has been shown that the interaction of rotor and stator can be controlled or corrected not only by radial deformation of the stator lining, but also, according to the invention, by axial shortening (compression) or lengthening (extension). Different measures are required for the shortening of the stator length, whereby a shortening both of the length of the lining and of the stator sleeve can be understood. A shortening of the length of the elastic stator lining can be achieved by a reduction in the distance between the contact surfaces of the lining on the pump housing and on the pressure flange.

If it is only in the installed state that the stator and thus the lining of the stator acquire the internal dimensions provided for the operation of the pump due to the desired axial compression, the assembly of the pump is facilitated. This results from the fact that the stator with a larger rest or initial internal geometry can be pushed more easily over the already assembled rotor.

With a suitable design of the stator and its lining, the start-up behaviour with the finish-mounted pump can also be influenced. For this purpose, provision is made to stretch the elastic stator lining. The elastic material of the lining thereby reduces the pressure on the rotor and thus facilitates the start-up behaviour by lowering the breakaway torque.

In a basic design for the axial shortening of the lining, its initially available distance between the pump housing or a part thereof and a pump end piece is shortened. According to the invention, one or more inserts in the form of rings are provided here. In the examples of embodiment, it is necessary for the stator sleeve and the stator lining to comprise separate parts. For the purpose of uniformly distributing the pressure or tensile force applied at the end over the whole stator length, the stator sleeve and the stator lining have contact surfaces running parallel to the longitudinal axis of the pump. Only in this way is a homogeneous cross-sectional reduction or increase possible, since no blockages are thereby created.

In order to make the adjustment of the pretensioning of the stator lining on the rotor more easily manageable, use may also be made of an adjusting ring controllable from the outside of the pump instead of the aforementioned insertion ring.

With this embodiment, the adjusting ring can be incorporated both in an end connection piece and also in the pump housing. The adjusting ring is axially mobile and, insofar as a fluid is used, provided with seals. If an electrical adjustment unit is used, the applied or generated tensioning between the adjusting ring and the lining is sufficient as a sealing force. By using a mobile adjusting ring, the stator lining can also be loaded or relieved of load by the supply and removal of a pressure medium during the pump operation. The adjusting ring, which is also referred to as adjusting spectacles on account of the cross-sectional shape of the duplex stator, can thus be the actuator for a control that responds to various operating parameters, such as the delivery pressure or the pump temperature. If the control detects an increase in the temperature, which is accompanied by an expansion of the elastomer, the pressure on the adjusting ring drops and the pretensioning on the rotor is reduced.

Since the stator lining and the stator sleeve are separate parts and the rotor transmits forces onto the stator lining, the latter itself tends to twist. This twisting must however be avoided in order to maintain the pump function. According to the invention, the stator lining and the stator sleeve are therefore not formed round, but polygonal at the contact surfaces. Rigid positioning can of course also be achieved by other surface shapes, such as a groove shape, a wedge shape or a wave shape.

Since the stator sleeve and the stator lining are separate parts, the lining can be rapidly replaced when necessary. For this purpose, provision is made according to the invention to form the stator sleeve from a profile with a longitudinal slot. A closure rail tensions and holds the profile stable. Without the closure rail, the two profile longitudinal sides open out from one another, the insertion and removal of the stator lining being greatly facilitated. The closure rail fits into the profile level on the inside of the stator sleeve. On the outside, the closure rail enters into a keyed connection with the longitudinal sides of the stator sleeve.

In order to increase the torsional reliability, the closure rail could of course also extend inwards, the lining then having to have a corresponding groove.

In order to simplify the method of production of the stator sleeve, the latter comprises a one-part or multi-part extruded profile in the longitudinal or transverse form. The stabilisation of the stator, which is dependent on the delivery pressure, is also taken into account by the selection of different materials in production. Various plastics as well as metals are therefore provided as materials for the stator sleeve.

BRIEF DESCRIPTION OF THE DRAWINGS

The figures described below show examples of embodiment of the invention:

FIG. 5 is a stator sleeve; and

FIG. 6 is a stator lining.

DETAILED DESCRIPTION OF THE INVENTION

Figure 1:
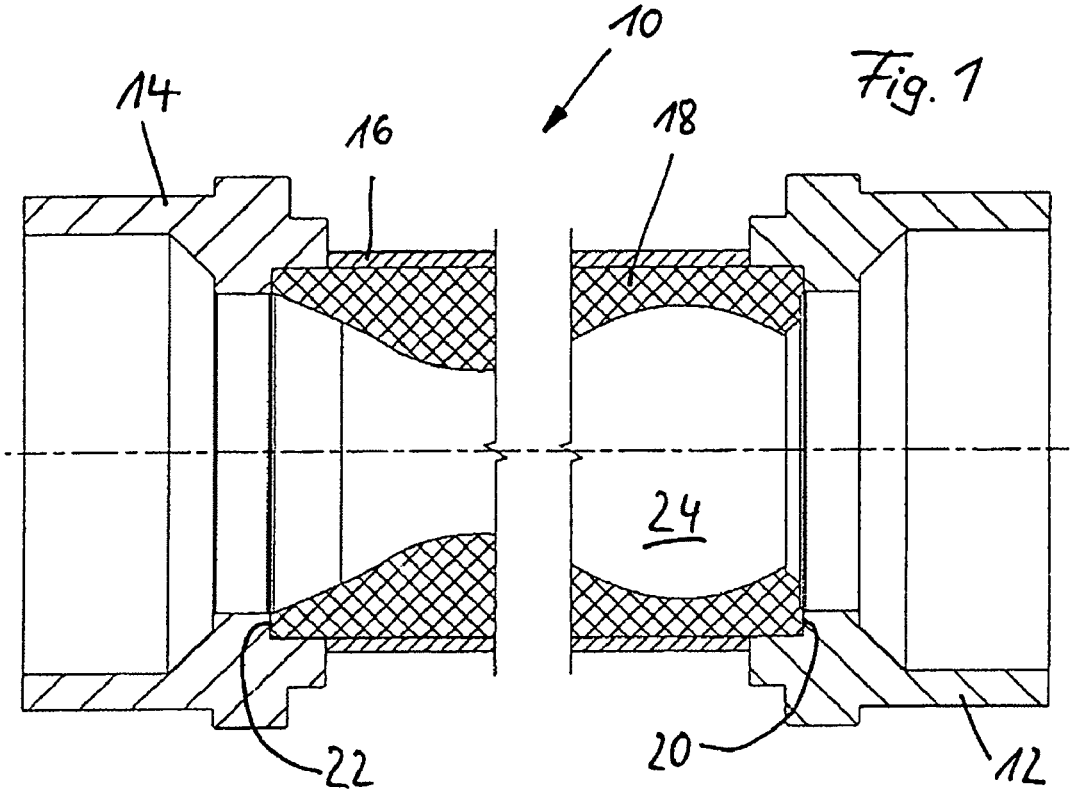
FIG. 1 is a partial section of an eccentric screw pump.

FIG. 1 shows a typical arrangement of a stator 10 in an eccentric screw pump. Stator 10 is clamped between a pressure flange 12 and pump housing 14. Tightening screws can be provided as clamping elements. The distance between pump housing 14 and pressure flange 12 is determined by the length of stator sleeve 16. As long as the stator sleeve and stator lining 18 are not installed between pump housing 14 and pressure flange 12, the two parts can be displaced axially towards one another. In the installed state, however, the stator lining is limited at both ends by a stop 20, 22. The stop comprises an annular end face, on the pressure flange or the pump housing. The length of the stator lining shown in FIG. 1 does not correspond to the length in the uninstalled state, but is already compressed slightly and accordingly is axially shortened. The length of the stator lining in FIG. 1 corresponds to the new state of the pump in the as-delivered condition. In this operational state, the ends of the stator lining are pretensioned only to such an extent that they give rise to a certain sealing function between delivery chamber 24 and the external atmosphere.

Figure 2:
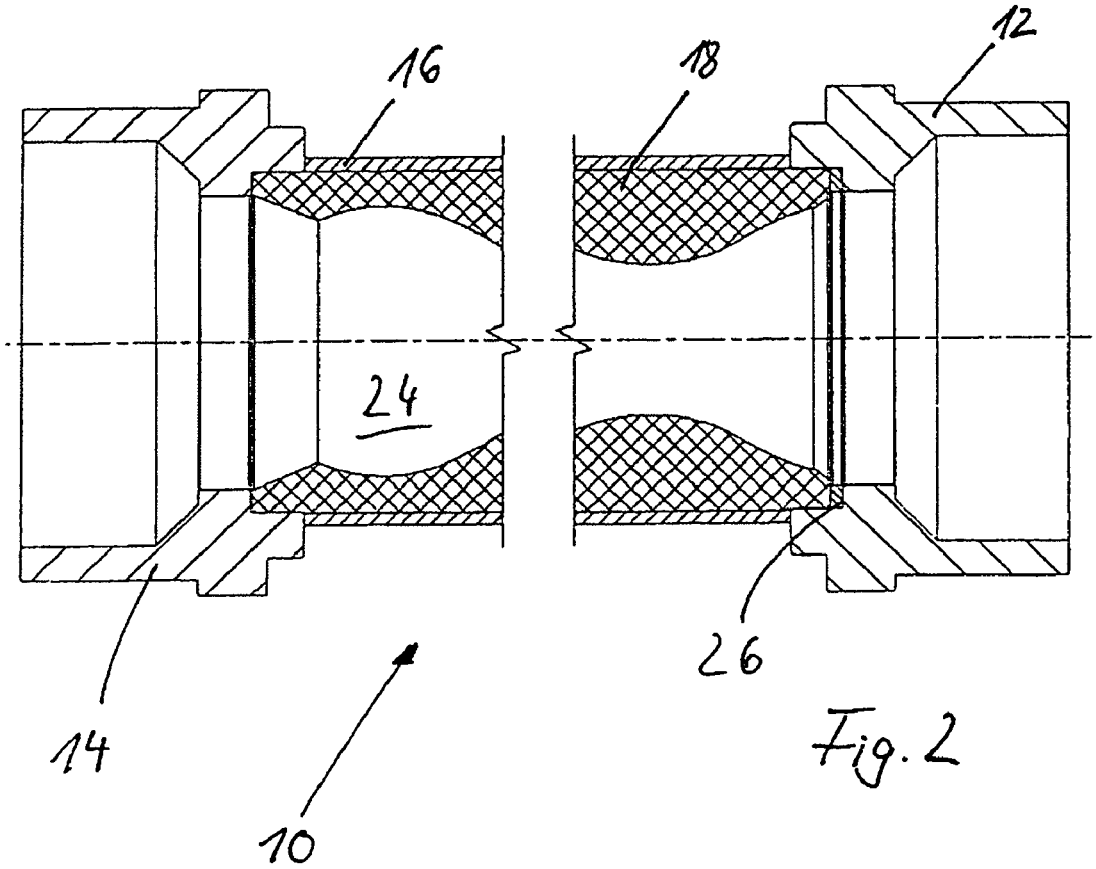
FIG. 2 is a partial section of an eccentric screw pump.

An axial change in the stator length caused by the operation, in particular the length of the stator lining, is shown in FIG. 2. An axial shortening has occurred here, for example, on the right-hand side of the stator lining. The shortening has arisen on account of a spacer ring 26, which sits in the region of the pressure flange between stop 20 and the complementary end face of the stator lining. The elastic material of the stator lining, which is pushed back by the spacer ring, is distributed over its whole internal surface. A larger internal surface thus arises, which leads to increased pressure on the rotor, which is not shown. This measure is taken when the delivery pressure diminishes in the region of pressure flange 12, which allows the conclusion that there is wear on the internal surface of the stator lining (referred to in the following as lining).

Figure 3:
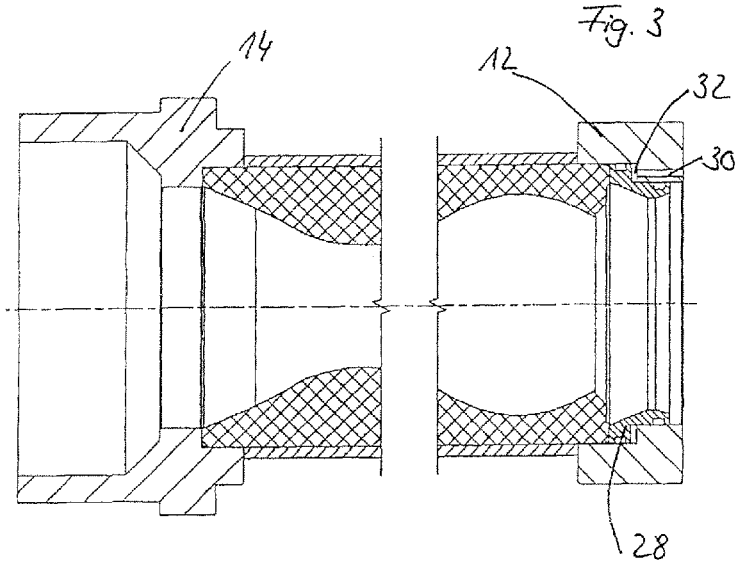
FIG. 3 is a partial section of an eccentric screw pump.
Figure 4:
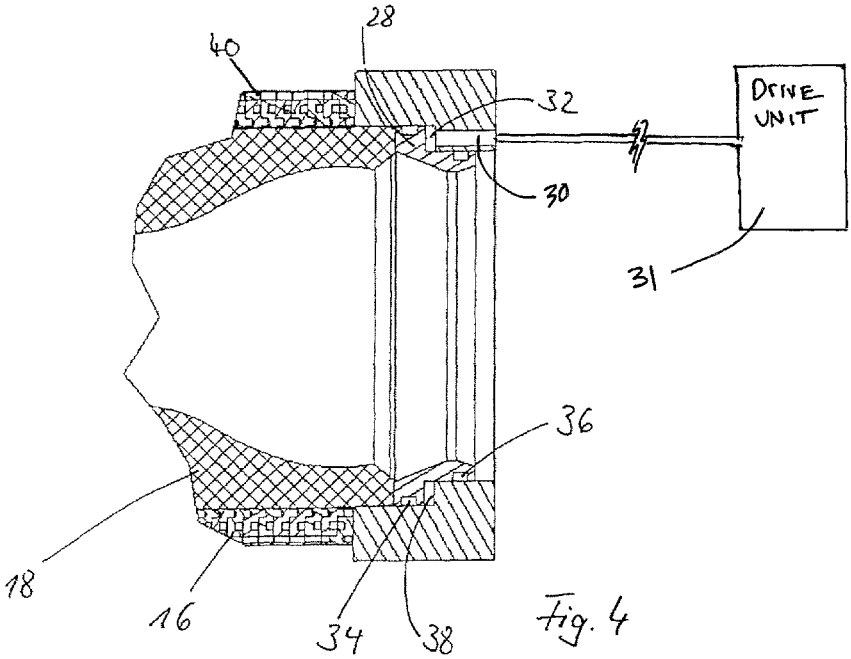
FIG. 4 is a partial section of a stator and eccentric screw pump.

A further possibility for changing the internal geometry of the stator lining is shown in FIGS. 3 and 4. The essential difference with this design is that a mobile adjusting ring 28 is used here. Adjusting ring 28 can be operated externally without assembly work on the pressure flange or the pump housing. For this purpose, the adjusting ring is provided with one or more adjusting screws, which can be operated from the surface of the pump. Apart from this mechanical variant, a hydraulic drive 31 can of course also be provided for the axial deformation of the stator lining. The hydraulic fluid passes via line 30 into annular chamber 32. The annular chamber is bounded by seals 34, 36 both in the direction of lining 18 and also on the product-carrying side.

The hydraulic pressure in the annular chamber can be controlled by a manually operated piston screw or automatically via a hydraulic system. The hydraulic system or an electrical device enable the operation of adjusting ring 28, depending on what pressure or temperature values are prevailing in the pump region. As can be seen from FIG. 3, annular chamber 32 is bounded by adjusting ring 28 and an end face 38 on the pressure flange.

If adjusting ring 28 lies against end face 38, the stator lining is only under a small amount of pretensioning. The more hydraulic fluid is pressed into the annular chamber, the more the lining is compressed and the smaller the internal dimensions become. If, during lengthy pumping, the distance by which the lining is compressed is not sufficient, this can be remedied by the shortening of the stator sleeve, whereby individual elements, e.g. annular elements, have to be removed.

FIG. 5 and FIG. 6 show lining 18 and stator sleeve 16, two separate components, which are not joined together over the whole area even during operation. The torsion-resistant arrangement of the lining in the stator sleeve takes place solely by positive locking by means of the polygonal internal and external shape of these elements. For the purpose of easier removal of the lining, the stator sleeve is provided with a longitudinal slot. The two longitudinal edges 42, 44 of the stator sleeve form with closure rail 46 a keyed connection. Closure rail 46 ends level at the inside of the stator sleeve. Although the stator sleeve is shown in one piece in FIG. 5, it can comprise several longitudinal or transverse parts. The important thing is that the diameter or the longitudinal slot of the stator sleeve without the closure rail is larger in order to facilitate the insertion or removal of the lining.

What is claimed is:

1. An eccentric screw pump, said pump comprising:

a stator comprising;

a stator sleeve extending along a longitudinal axis of said pump;

a stator lining disposed in said stator sleeve, said stator lining extending along said longitudinal axis, said stator lining being axially displaceable along said longitudinal axis relative to said stator sleeve, wherein a length of said stator lining along said longitudinal pump axis is varied to uniformly distribute force along said stator, and wherein the stator comprises an elastic material;

a flange arranged at a first end of said stator;

a pump housing arranged at a second end of said stator; and an adjusting ring, said adjusting ring being axially displaceable relative to said flange and said pump housing along said longitudinal axis;

wherein an actuation of said adjusting ring relative to said flange and said pump housing along said longitudinal axis causes said stator lining to deform along said longitudinal axis.

2. The eccentric screw pump according to claim 1, wherein said axial displacement of said adjusting ring is actuated by a hydraulic system.

3. The eccentric screw pump according to claim 1, wherein said axial displacement of said adjusting ring is actuated by a pneumatic system.

4. An eccentric screw pump, said pump comprising:

a stator comprising;

a stator sleeve extending along a longitudinal axis of said pump;

a stator lining disposed in said stator sleeve, said stator lining extending along said longitudinal axis, said stator lining being axially displaceable along said longitudinal axis relative to said stator sleeve, wherein a length of said stator lining along said longitudinal pump axis is varied to uniformly distribute force along said stator, and wherein the stator comprises an elastic material; and an adjusting ring, wherein said adjusting ring has a diameter discontinuity.

5. The eccentric screw pump according to claim 4, wherein seals, that bound an annular chamber, are provided both in the region of the larger and in the region of the smaller diameter of the adjusting ring.

6. A method for the operation of an eccentric screw pump, comprising the steps of:

providing a stator sleeve extending along a longitudinal axis, and have a substantially cylindrical cross section in a plane substantially perpendicular to said longitudinal axis;

providing a stator lining disposed in said stator sleeve and extending along said longitudinal axis, wherein said stator sleeve is displaceable relative to said stator lining along said longitudinal axis;

varying a length of said stator lining along said longitudinal axis to uniformly distribute force along a contact surface of said stator lining running substantially parallel to said longitudinal axis;

providing a flange arranged at a first end of said stator;

providing a pump housing arranged at a second end of said stator;

providing an adjusting ring, said adjusting ring being axially displaceable relative to said flange and said pump housing along said longitudinal axis; and actuating the adjusting ring thereby deforming the stator lining along the longitudinal axis.

* * * * *